US009145669B1

(12) United States Patent
Broughton

(10) Patent No.: US 9,145,669 B1
(45) **Date of Patent: *Sep. 29, 2015**

(54) APPARATUS AND METHOD FOR ATTACHING DECK TO STRUCTURE

(71) Applicant: Lance Broughton, Wentzville, MO (US)

(72) Inventor: Lance Broughton, Wentzville, MO (US)

( * ) Notice: Subject to any disclaimer, the term of this patent is extended or adjusted under 35 U.S.C. 154(b) by 9 days.

This patent is subject to a terminal disclaimer.

(21) Appl. No.: 14/270,090

(22) Filed: May 5, 2014

(51) Int. Cl.
*E04H 12/00* (2006.01)
*E04B 1/00* (2006.01)
*E04B 5/12* (2006.01)

(52) U.S. Cl.
CPC .. *E04B 1/003* (2013.01); *E04B 5/12* (2013.01)

(58) Field of Classification Search
CPC ..... E04B 1/003; E04B 1/0038; E04B 1/38; E04B 1/40; E04B 2001/2644; E04B 2001/405; E04B 2001/2415; E04B 1/2612; E04B 1/2604; E04B 1/2603
USPC ..... 52/289, 655.1, 698, 704, 712, 713, 52/745.21; 403/258–260, 231, 247, 232.1
See application file for complete search history.

(56) References Cited

U.S. PATENT DOCUMENTS 4,114,328 A * 9/1978 Lawrence ..... 52/79.1
4,811,542 A * 3/1989 Jewell ..... 52/745.21
5,201,156 A * 4/1993 Newman ..... 52/299
5,242,239 A * 9/1993 Hosokawa ..... 403/258
6,397,552 B1 6/2002 Bourque
6,427,391 B1 * 8/2002 Lyons ..... 52/73
2005/0160683 A1 * 7/2005 Eldeen ..... 52/73
2005/0284056 A1 * 12/2005 Ghiringhelli ..... 52/289
2008/0302037 A1 * 12/2008 Brown et al. ..... 52/289
2012/0315081 A1 * 12/2012 Bouldin et al. ..... 403/205
2013/0298494 A1 * 11/2013 Corsi ..... 52/705
2014/0013701 A1 * 1/2014 Rodgers ..... 52/698
2014/0215956 A1 * 8/2014 Smith et al. ..... 52/705

OTHER PUBLICATIONS

Schneider, III; "Lateral Support of Residential Deck Structures, a Primer;" Mar. 1, 2011.
"A deck lateral load connection to meet IRC® 2009/2012;" *Deck Harness*™; Jan. 2014; GRK Fasteners.
"Deck Lateral Load Connections to Meet the 2009/2012 IRC for Multiple Conditions;" *Technical Bulletin*; May 2011; pp. 1-2; Simpson Strong-Tie Company Inc.
Dec. 3, 2014 Office Action issued in U.S. Appl. No. 14/456,513.
Feb. 18, 2015 Office Action issued in U.S. Appl. No. 14/456,513.

* cited by examiner

*Primary Examiner* — Brian D Mattei
(74) *Attorney, Agent, or Firm* — Oliff PLC

(57) ABSTRACT

A system and method for attaching a deck to a structure. The system includes at least one attachment plate provided with at least one fastening component. The fastening component is fastened to the structure ledger and extends into the end face of the structure floor joist.

19 Claims, 11 Drawing Sheets

APPARATUS AND METHOD FOR ATTACHING DECK TO STRUCTURE

BACKGROUND

Requirements for attaching a deck to a structure, such as a house, include having the attachment comply with the international residential code (IRC). The IRC requires a deck-to-house connection that is capable of withstanding a particular lateral and tension load, such as 1500 pounds.

To achieve the appropriate tension connection for such a load, some methods involve screwing metal connectors onto each side of the connection, e.g., one connector attached to the side of a deck joist and a corresponding connector attached to the side of a house joist. In such a method, a ½" diameter threaded rod is generally threaded through each of the two paired metal connectors in order to connect the side of the deck joist to the side of the house joist (house floor joist) to ensure an adequate tension connection. This method requires the person installing the deck to have access to the interior of the house in order to install the steel connector onto the side of the house joist. Further, such a connection would require the installer to drill a hole into the house band board in order to pass the rod through the house band board so as to connect the steel connector to the deck joist.

In some other known attachment configurations, an attachment bracket of a deck ledger (deck rim joist) may be mounted to a concrete foundation of a house, as described in U.S. Pat. No. 6,397,552, which is incorporated herein by reference in its entirety.

In these configurations, the installer is generally required access to the house. In many practical situations, installer access to the house is difficult or undesirable, and can create inefficiencies in the construction process. Further, the installer may have to remove and later fix drywall on the house interior in order to make the house connection, which involves further inefficiencies.

Additionally, the orientation of the threaded rod or other connecting component in some of the related art configurations will create a thermal bridge between the exterior and interior of the house. This thermal bridge, especially in areas prone to significant temperature fluctuations, can create condensation on the steel connector and the threaded rod. This can lead to wood deterioration and/or formation of mold.

SUMMARY

The instant application seeks to remedy some or all of the deficiencies for known connections of a deck to a structure. This summary is provided to introduce a selection of concepts that are further described below in the detailed description. This summary is not intended to identify key or essential features of the claimed subject matter, nor is it intended to be used as an aid in limiting the scope of the claimed subject matter. The statements made merely provide information relating to the present disclosure, and may describe some embodiments illustrating the subject matter of this application.

In an aspect, a deck attachment system for attaching a deck having a deck joist and a deck ledger to a structure having a floor joist and a structure ledger is disclosed. The system includes at least one attachment plate with one or more fastener holes, at least one fastening component oriented so as to be capable of attaching the at least one attachment plate to at least one of the deck ledger and the structure ledger, and at least one connecting component capable of connecting the attachment plate to at least a portion of the deck joist. The at least one fastening component is configured to be fastened into an end face of the floor joist of the structure.

In another aspect, a deck attachment system includes a structure ledger, a structure floor joist, a deck ledger, a deck joist, at least one attachment plate with at least one fastener hole, at least one connecting component for directly or indirectly connecting the at least one attachment plate with the deck ledger and/or deck joist, and at least one fastening component that attaches the attachment plate, via the at least one fastener hole, to at least one of the deck ledger and the structure ledger. The at least one fastening component is fastened into an end face of the structure floor joist.

In another aspect, a method for attaching a deck to a structure is disclosed. The method includes fastening an attachment plate to at least one of a structure ledger or a deck ledger by means of at least one fastening component, and connecting the attachment plate to a deck joist by means of a connecting component. The at least one fastening component is fastened into an end portion of a structure floor joist.

DETAILED DESCRIPTION

Figure 1:
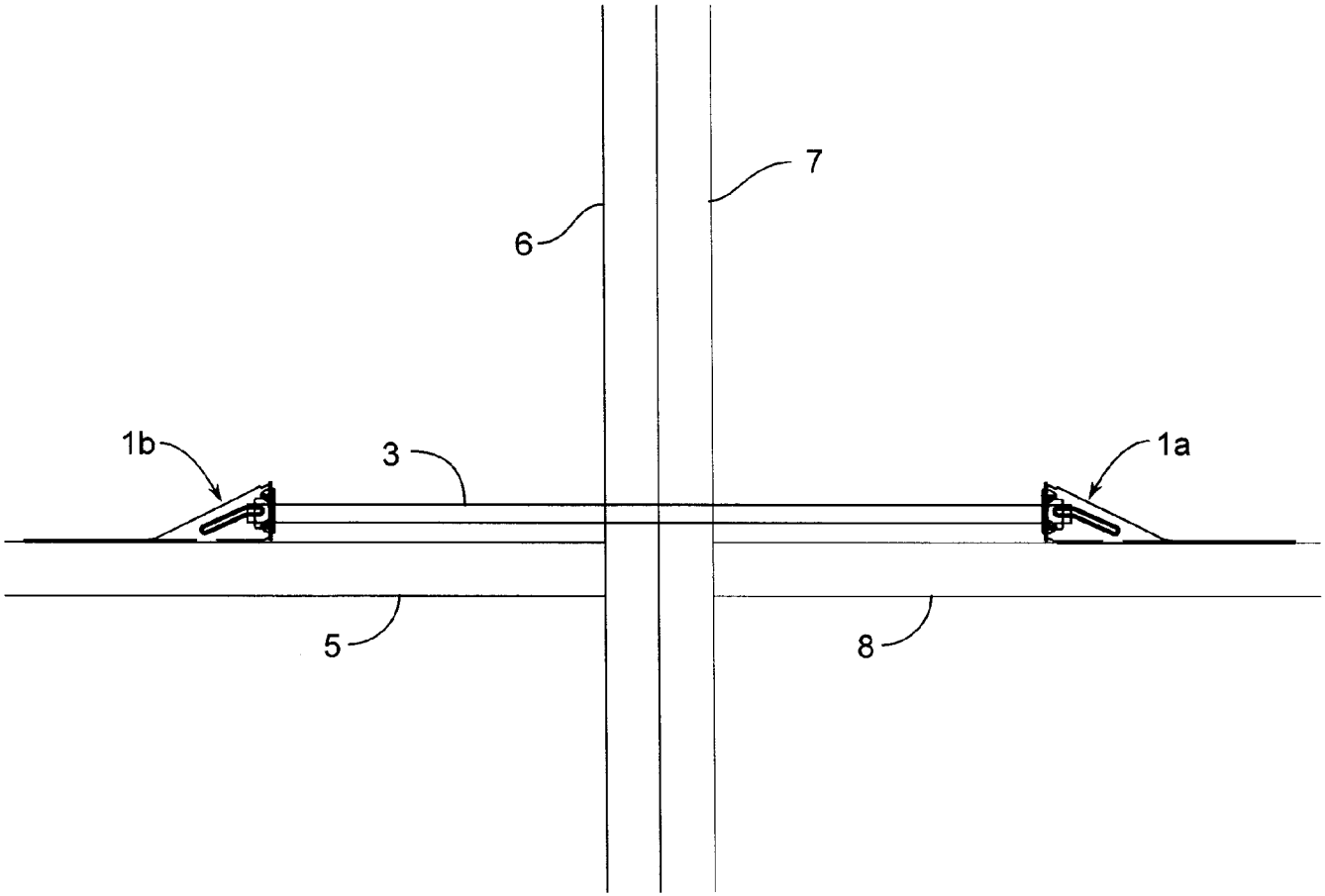
FIG. 1 RELATED ART
FIG. 1 shows a deck attachment system of the related art.

In the following description, numerous details are set forth to provide an understanding of the present disclosure. However, it may be understood by those skilled in the art that the methods of the present disclosure may be practiced without these details and that numerous variations or modifications from the described embodiments may be possible.

At the outset, it should be noted that in the development of any such actual embodiment, numerous implementation—specific decisions may be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the device and method described herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a range listed or described as being useful, suitable, or the like, is intended to include support for any conceivable sub-range within the range at least because every point within the range, including the end points, is to be considered as having been stated. For example, "a range of from 1 to 10" is to be read as indicating each possible number along the continuum between about 1 and about 10. Furthermore, the subject matter of this application illustratively disclosed herein suitably may be practiced in the absence of any element(s) that are not specifically disclosed herein.

The following definitions are provided in order to aid those skilled in the art in understanding the detailed description.

As used herein, the term "fastening component" refers to any component capable of securing one member to another, such as glue or other adhesives, screws and nails.

As used herein, the term "connecting component" refers to a structure capable of performing a direct or indirect connection from one member to another. In some embodiments, a connecting component may be a threaded rod made of metal, but one skilled in the art would also understand that any component capable of causing a connection between two members, such as a wooden rod, a block, a plate or portion of a plate with screws, a chain or the like, can also be considered a connecting component as it applies to this disclosure. A connecting component as particularly used herein may connect, directly or indirectly, a deck to a structure, further accommodating the appropriate weight and tension transfer between the deck and structure, so as to comply with the appropriate building codes.

The term "structure" as used in this application refers to an anchored structure capable of having a deck connected to it. The structure may be a house, a commercial building, an apartment, or any anchored structure. The structure may or may not be subject to IRC residential codes.

The term "deck" as used herein refers to any formation that is capable of being attached or otherwise connected to a structure. Though the deck as referred to herein generally refers to an exterior deck (e.g., to be constructed on an outside of the structure), one skilled in the art would appreciate that a deck may also be attached, at least in part, to an interior portion of the structure. One skilled in the art would recognize that the deck may be made of suitable wood, but also of any other suitable material, such as plastic or metal.

Referring to FIG. 1, a deck attachment system of the related art is shown. The system utilizes a bracket 1*a* attached to a side face of a house joist 8. A corresponding bracket 1*b* is attached to a side face of a deck joist 5. A connecting device 3, such as a rod, connects bracket 1*a* to bracket 1*b*. The connecting device passes through holes drilled in the house ledger 7 and deck ledger 6, respectively. One skilled in the art would recognize that the house ledger as defined and shown herein also corresponds to a "house rim joist," and the deck ledger as defined herein corresponds to a "deck rim joist," as commonly referred to in the art.

Figure 2:
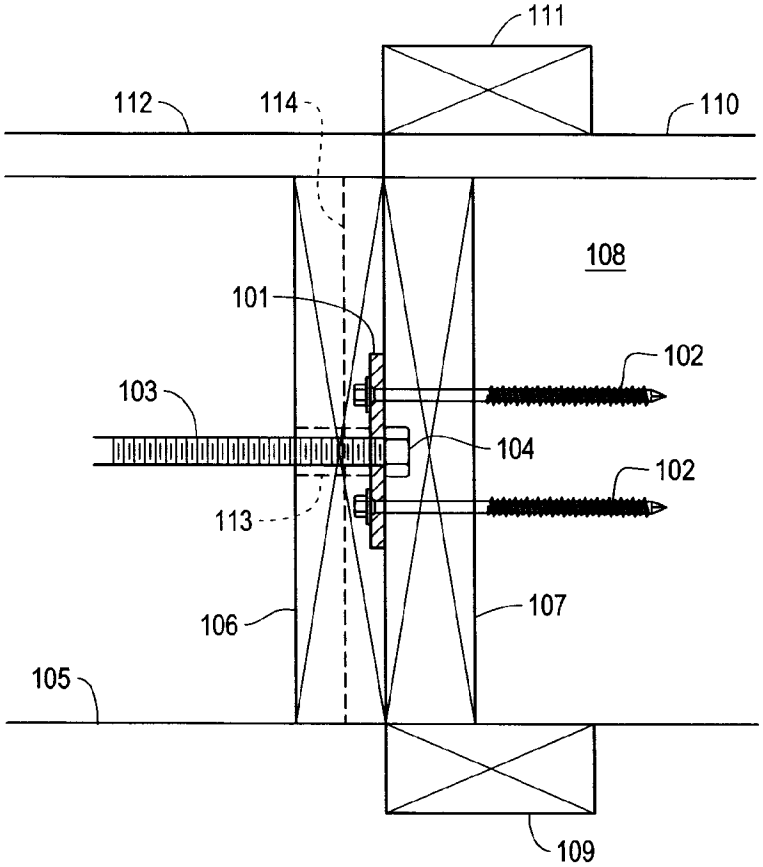
FIG. 2 shows a deck attachment system according to a first embodiment.
Figure 3:
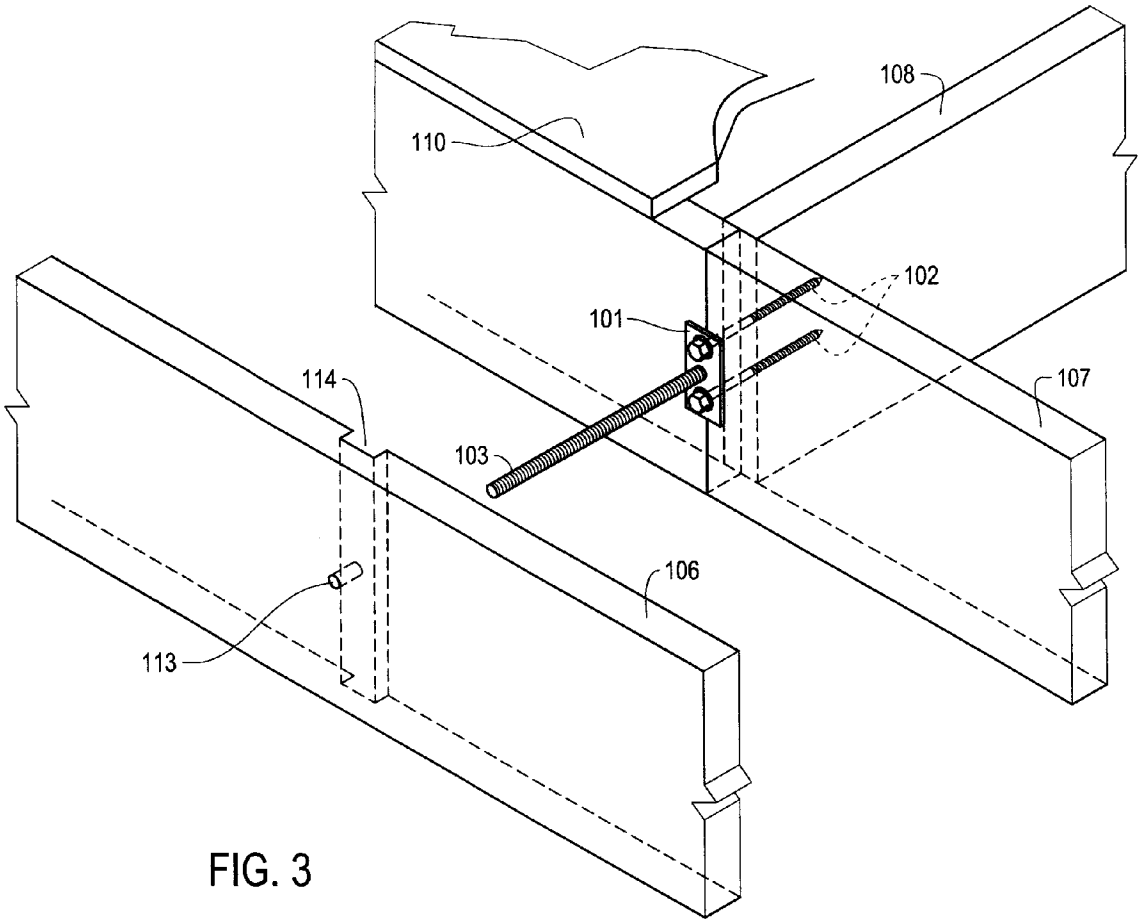
FIG. 3 shows an isometric view of the deck attachment system according to the first embodiment.

Referring to FIGS. 2 and 3, a first embodiment describing a system for attaching a deck to a structure is shown. The attachment may be for a connection that is capable of withstanding a lateral and tension load, as opposed to a gravity load. The structure may be a house. The deck attachment system may be provided at a location under the decking 112 and structure sub-floor 110. The house structure may include a house sill plate 109, which is a sill plate on top of a foundation wall of the house, and a house wall sill plate 111. The house wall sill plate may be at a bottom of the framed house wall.

The deck attachment system includes an attachment plate 101. The attachment plate may be provided on a longitudinal face of the house ledger (rim joist) 107. The attachment plate may particularly be provided on the outside longitudinal face of the house ledger (the face closest in distance to the deck ledger 106).

The attachment plate 101 may be formed from a single material, such as sheet metal. In some embodiments, the material will be selected based upon stress/strain characteristics and having a length, width and thickness sufficient to ensure that the deck-house connection is capable of withstanding a lateral load required by the IRC.

The attachment plate 101 may have a length of about 3 to about 14 inches, and a width from about 1 to about 4 inches. Further, the attachment plate may have a length of about 3 inches and a width of about 1.5 inches.

The attachment plate 101 may be substantially rectangular in shape, or may be of any shape so as to allow for proper and acceptable weight transfer. The thickness of the attachment plate may be designed in relation to the necessary weight bearing and tension requirements for the connection to be performed. The attachment plate 101 may have a thickness of about 3/16 inches to about ¾ inches. Further, the attachment plate 101 may have a thickness of about ¼ inches.

In addition to sheet metal, any material found capable of providing the proper tension connection may be used, such as molded plastics, composites, and castable materials such as other metals.

The attachment plate 101 may be provided with one or more connecting holes for connecting the attachment plate with the deck joist 105. In some embodiments, through the one or more connecting holes, a connecting component 103 may be placed through the metal plate and through a hole 113 of the deck ledger (deck rim joist) 106. The attachment plate 101 may be connected, directly or indirectly, to the house ledger (house rim joist) 107). The connecting component may be anchored by means of a nut 104 disposed on the end of the connecting component at the inner face of the deck ledger 106. The connecting component may or may not extend into the house ledger 107. The connecting component may be a threaded rod, or any other component capable of properly connecting the attachment plate to the deck joist. In embodiments where a threaded rod is used, the threaded rod may be threaded through the hole 113 in the deck ledger, and reach the deck joist 105. The threaded rod 103 may be connected to the deck joist 105 by means of traditional connections known to one skilled in the art, such as by brackets. The hole 113 may be drilled by a standard drill, such as a power drill or a hand drill.

The attachment plate 101 may also be provided with one or more attachment holes to enable fastening of the attachment plate to the house. The attachment holes may be pre-drilled into the attachment plate, or may be created during the attachment process. In some embodiments, fastening components such as screws 102 are utilized to fasten the attachment plate to the house ledger 107. The screws may be further threaded into the end face of the house joist (house/structure floor joist) 108. In some embodiments, the end face that the screws are threaded into is the end grain of the house joist 108. In some embodiments, two screws are used to connect the attachment plate 101 to the house joist 108. While two screws have been found to allow for proper fastening and accommodates the required weight distribution, one skilled in the art would understand that the number of screws that can be used is not limited to two, and may in fact be one, or three, or four or more, provided that the attachment satisfies weight bearing and/or tension requirements of applicable building codes. It would also be understood to one skilled in the art that the attachment plate 101 can be fastened to the house ledger 107 by means other than screws, thereby using zero screws, provided that the building codes are still satisfied. Further, the attachment plate may alternatively or additionally be fixed, with or without screws, directly to the house joist 108.

Further, though only one attachment plate 101 is shown, one skilled in the art would recognize that a plurality of attachment plates can be used, each being secured to appropriate locations on and along the length of the house ledger, provided that the attachment plates in sum accommodate the required weight bearing requirements under applicable building codes. For example, some embodiments may use only two attachment plates, one at either end of the length of the house ledger. Additional attachment plates may also be located between the length ends of the house ledger, if desired or required.

The screws 102 may be lag screws, and may have a lag length of about 2 inches to about 8 inches, or about 2 inches to about 6 inches. The screws may have a screw diameter of about ¼ inches to about ⅜ inches, or about 5/16 inches. The screws may be screwed a distance into the end face of the house joist 108, so as to ensure adequate attachment and proper weight transfer in accordance with IRC standards or any other applicable standards. To achieve this, the attachment plate should be lined up with the house joist such that the attachment holes are aligned with the end face of the house joist, and thus the screws may be readily inserted into the end face of the house joist. In some embodiments, the lag screws are screwed at least 2 inches into the end face of the house joist 108, as measured from the screw insertion point at the base of the house joist to the last thread of the screw before the point of the screw. The lag screws may also be screwed about 2 inches to about 4.5 inches into the end face of the house joist, or about 2.5 inches. The screws 102 may be in direct withdraw, and thus are capable of being pulled straight out without any of twisting or rotation of the screws. Thus, the screws 102 do not have to be laterally loaded, though one skilled in the art would appreciate that the screws 102 are capable of being laterally loaded. To allow for the appropriate connections of the deck to the house to be made given the inclusion of the screws and attachment plates and the like, a channel 114 may be cut into the deck ledger 106 to accommodate for the additional components while still allowing the deck ledger 106 and house ledger 107 to ultimately remain in a flush arrangement.

Owing to the configuration described above, a lateral load can be applied to the connecting component 103, via a traditional connection of the deck joist 105 and the connecting component 103 known to one skilled in the art. The load can then be transferred to the attachment plate 101, for example by means of the nut 104 on the end of the connecting component 103. The load at the attachment plate 101 can then be transferred to the one or more screws 102, which are screwed through the house ledger 107 and into the end face of the house joist 108. Thus, the lateral load is ultimately transferred to the house joist 108.

Figure 4:
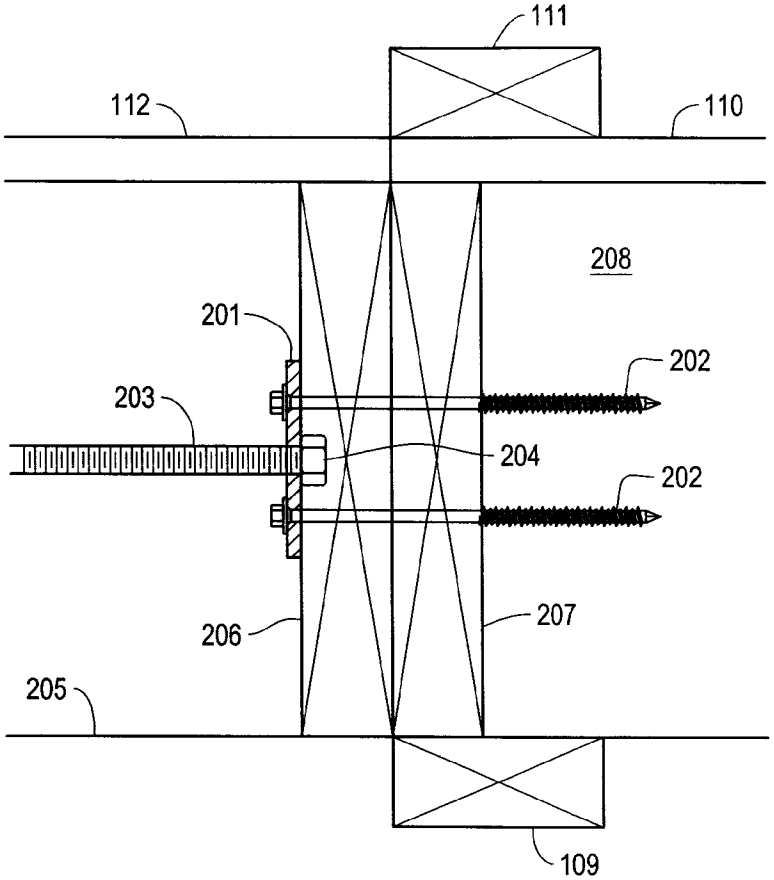
FIG. 4 shows a deck attachment system according to a second embodiment.
Figure 5:
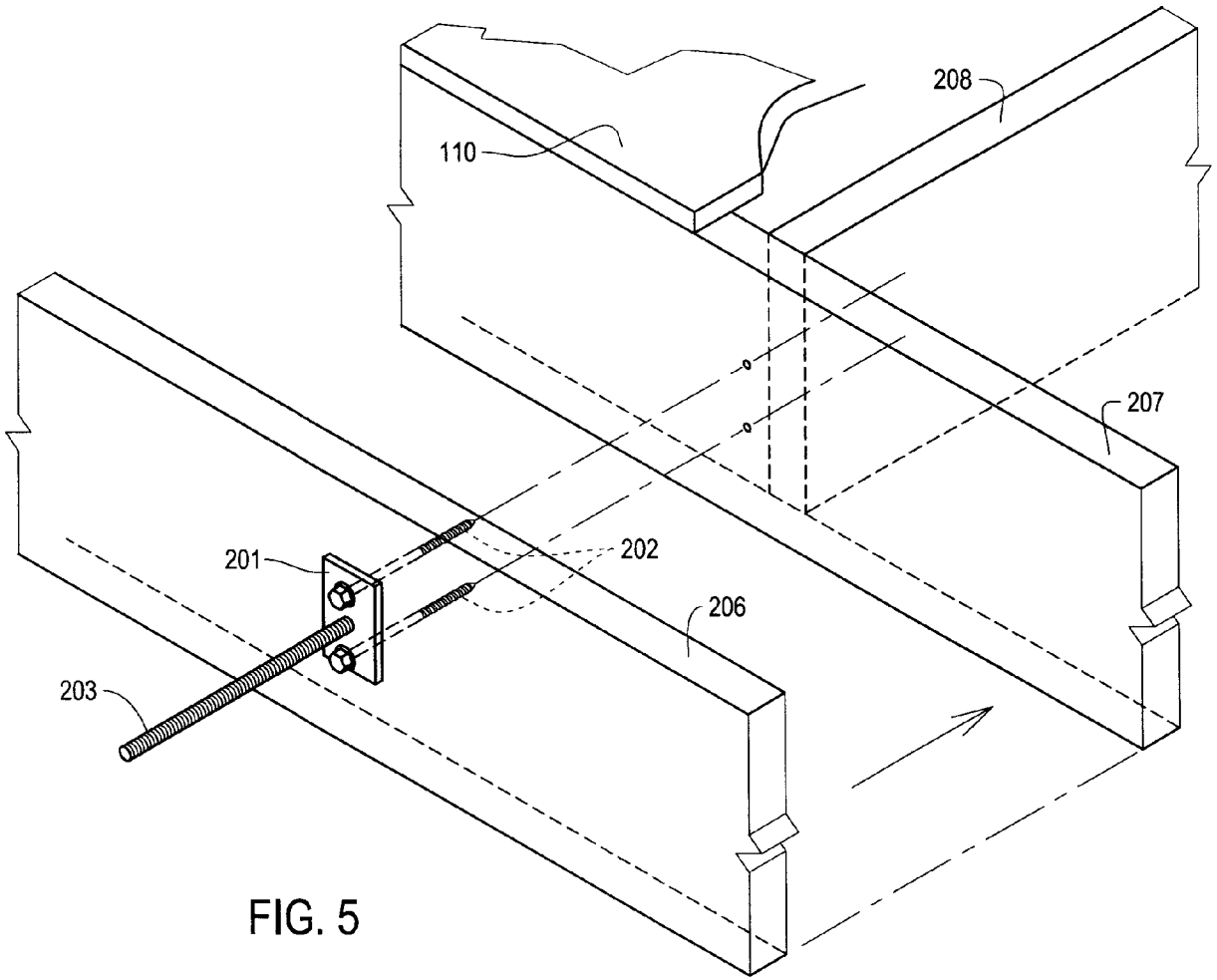
FIG. 5 shows an isometric view of the deck attachment system according to the second embodiment.

Referring to FIGS. 4 and 5, a second embodiment describing a system for attaching a deck to a house is shown. The embodiment shown in FIGS. 4 and 5 has similar structural characteristics to the embodiments shown in FIGS. 2 and 3, but an attachment plate 201 may be provided on an outer face of the deck ledger 206 rather than into the house ledger 107 as in FIGS. 2 and 3.

The attachment plate 201 may be provided with a connecting hole for connecting the attachment plate with the deck joist 205. Fastening components such as lag screws 202 are utilized to fasten the attachment plate through the deck ledger 206 and ultimately to the house ledger 207. In this embodiment, the lag screws are long enough to reach from the attachment plate 201 disposed on the outside of the deck ledger 206 to the house ledger 207. The screws may be further threaded into the end face of the house floor joist 208. The lag screws 202 may be of a length from about 2 inches to about 8 inches, or about 4 inches to about 8 inches.

Further, though only one attachment plate 201 is shown, one skilled in the art would recognize that a plurality of attachment plates can be used, each being secured to appropriate locations on and along the length of the house ledger, provided that the attachment plates in sum accommodate the required weight bearing requirements under applicable building codes. For example, some embodiments may use only two attachment plates, one at either end of the length of deck ledger. Additional attachment plates may also be located between the length ends of the deck ledger, if desired or required.

A connecting rod 203 may extend from the attachment plate to the deck joist 205. The connecting rod 203 may or may not extend into the house ledger 207. The connecting rod 203 may be connected to the deck joist 205 by traditional methods known to one skilled in the art, such as by brackets. The connecting rod may be fixed at an inside end of the attachment plate by a nut 204.

Owing to the configuration described above, a lateral load can be applied to the connecting component 203, via a traditional connection of the deck joist 205 and the connecting component 203 known to one skilled in the art. The load can then be transferred to the attachment plate 201, for example by means of the nut 204 on the end of the connecting component 203. The load at the attachment plate 201 can then be transferred to the one or more screws 202, which are screwed through the deck ledger 206 and the house ledger 207 and into the end face of the house joist 208. Thus, the lateral load is ultimately transferred to the house joist 208.

Figure 6:
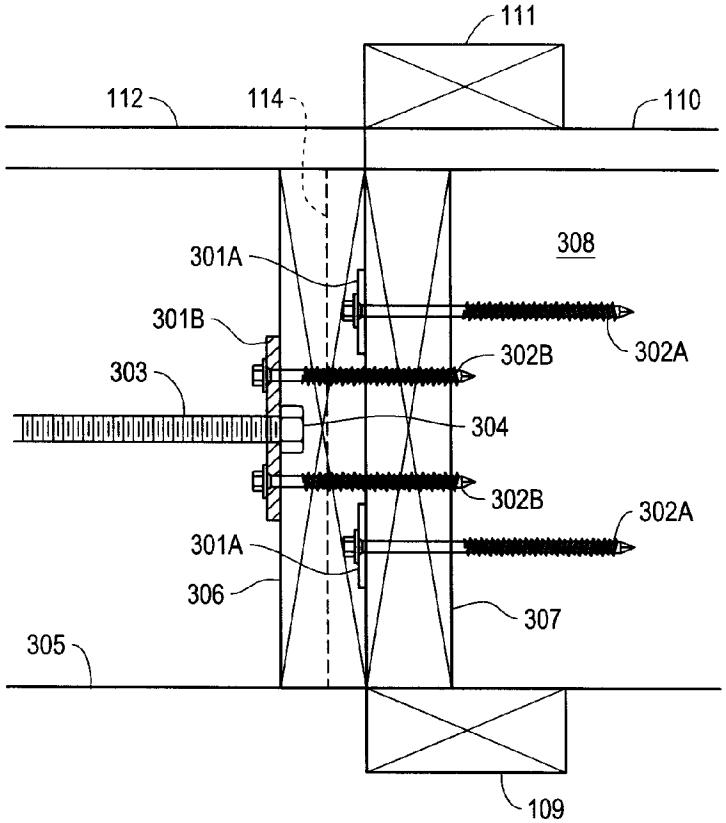
FIG. 6 shows a deck attachment system according to a third embodiment.
Figure 7:
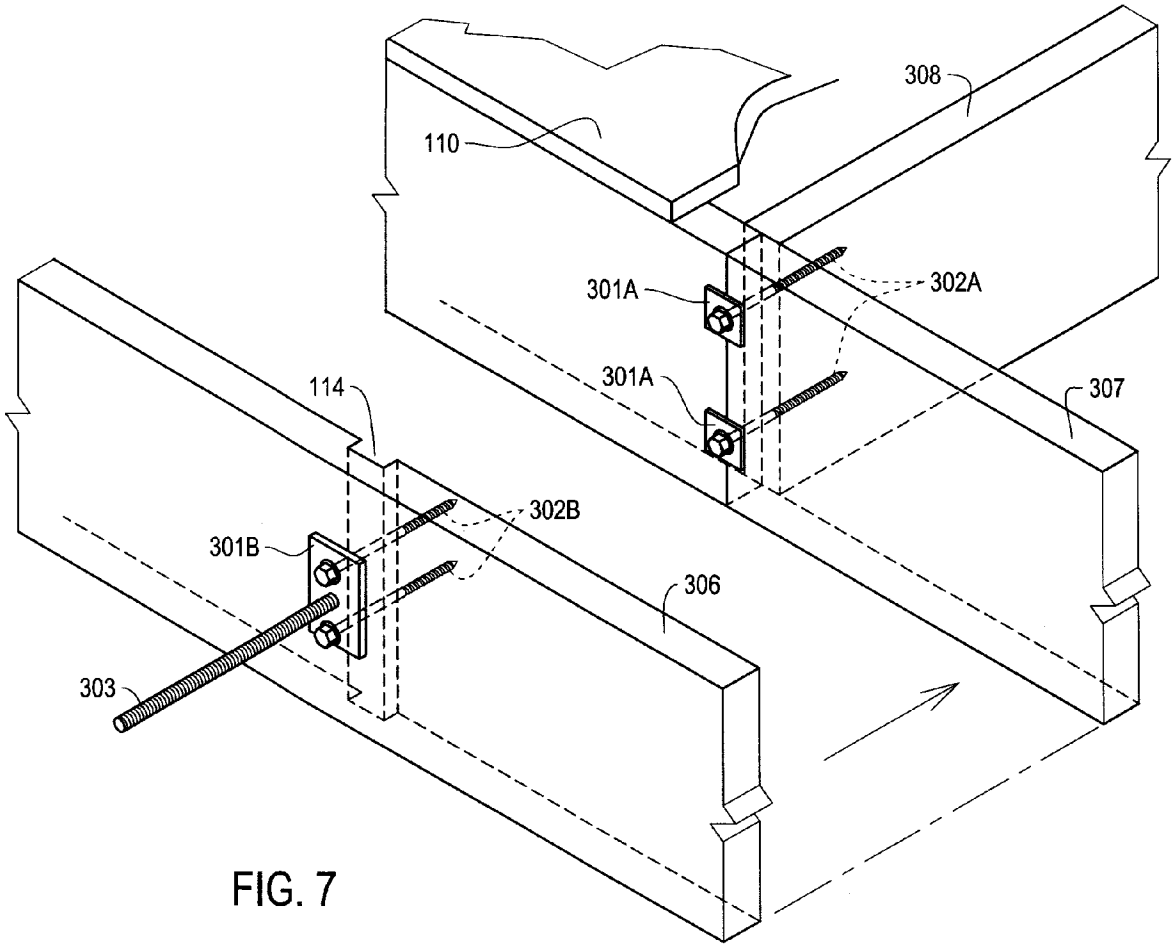
FIG. 7 shows an isometric view of the deck attachment system according to the third embodiment.

Referring to FIGS. 6 and 7, a third embodiment describing a system for attaching a deck to a house is shown. The embodiment shown in FIGS. 6 and 7 has similar structural characteristics to the embodiments shown in FIGS. 2 and 3, but a plurality of attachment plates may be used. As can be seen in FIGS. 6 and 7, one or more attachment plates 301A can be provided on the outside longitudinal face of the house ledger 307. Each of the one or more attachment plates 301A may include attachment holes to enable one or more fastening components such as screws 302A to attach the attachment plates 301A to the house ledger 307. The screws may be further threaded into the house joist 308.

Additionally, an attachment plate 301B may be provided on an outside longitudinal face of the deck ledger 306. The attachment plate may include a plurality of attachment holes, and through at least one of those holes, one or more fastening components such as screws 302B that extend into the house ledger 307 may be provided. The one or more screws 302B may protrude through the house ledger 307, but not through the house joist 308. In some configurations, the one or more screws may protrude through both the house ledger 307 and house joist 308.

The attachment plate 301B may be provided with one or more connecting holes for connecting the attachment plate 301B to the deck. In some embodiments, through the one or more connecting hole, a connecting component 303 may be placed through the metal plate and into the deck ledger 306. The connecting component 303 may be anchored by means of a nut 304 disposed on the end of the connecting component 303 at a location along the longitudinal inner face of the deck ledger 306, for example at an end of the connecting component closest to the house ledger 307. As with the first two embodiments, the connecting component may a threaded rod, or any other component capable of properly directly or indirectly connecting the attachment plate to the deck ledger and/or deck joist. In embodiments where the threaded rod is used, the threaded rod may be threaded through a hole on a surface of the deck ledger, and reach the deck joist 305. The threaded rod 303 may be connected to the deck joist 305 by means of traditional connections known to one skilled in the art, such as by brackets.

In this embodiment, when a lateral load is applied to connecting component 303, the load may be transferred to the attachment plate 301B by means of a nut 304 on an end of the connecting component 303. The attachment plate 301B load is then transferred to the screws 302B, which are screwed through the deck ledger 306 and into the house ledger 307. This transfers the load to the house ledger 307. The load on the house ledger 307 can then be transferred to the one or more attachment plates 301A via their direct or indirect connections and any applied tension, and the load at the attachment plates 301A can be transferred to the screws 302A, which are screwed through house ledger 307 and into the house joist 308.

Figure 8:
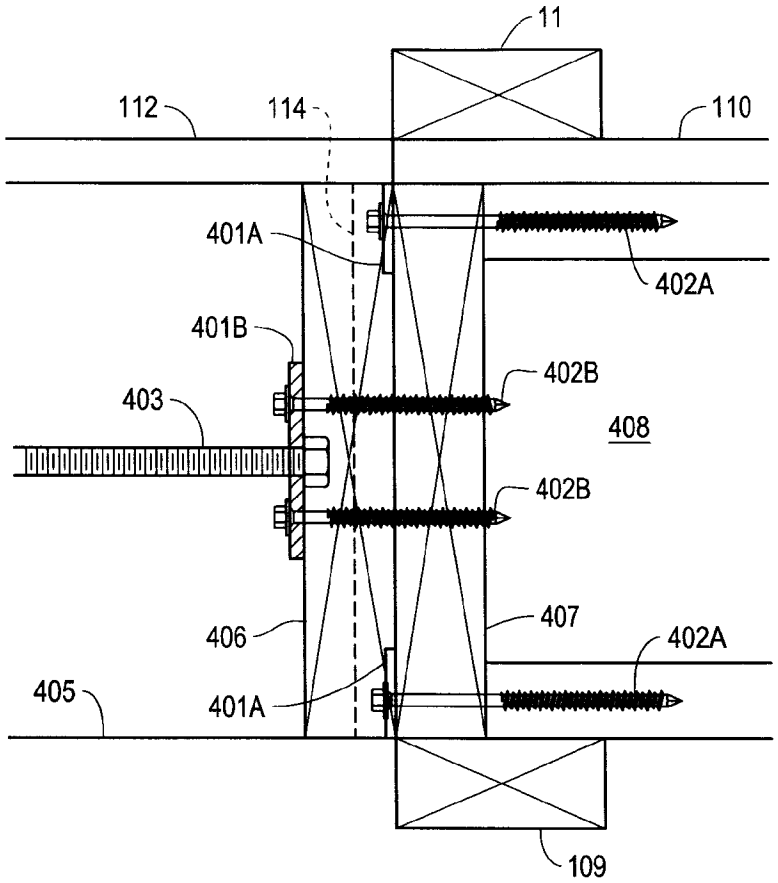
FIG. 8 shows a deck attachment system according to a fourth embodiment.
Figure 9:
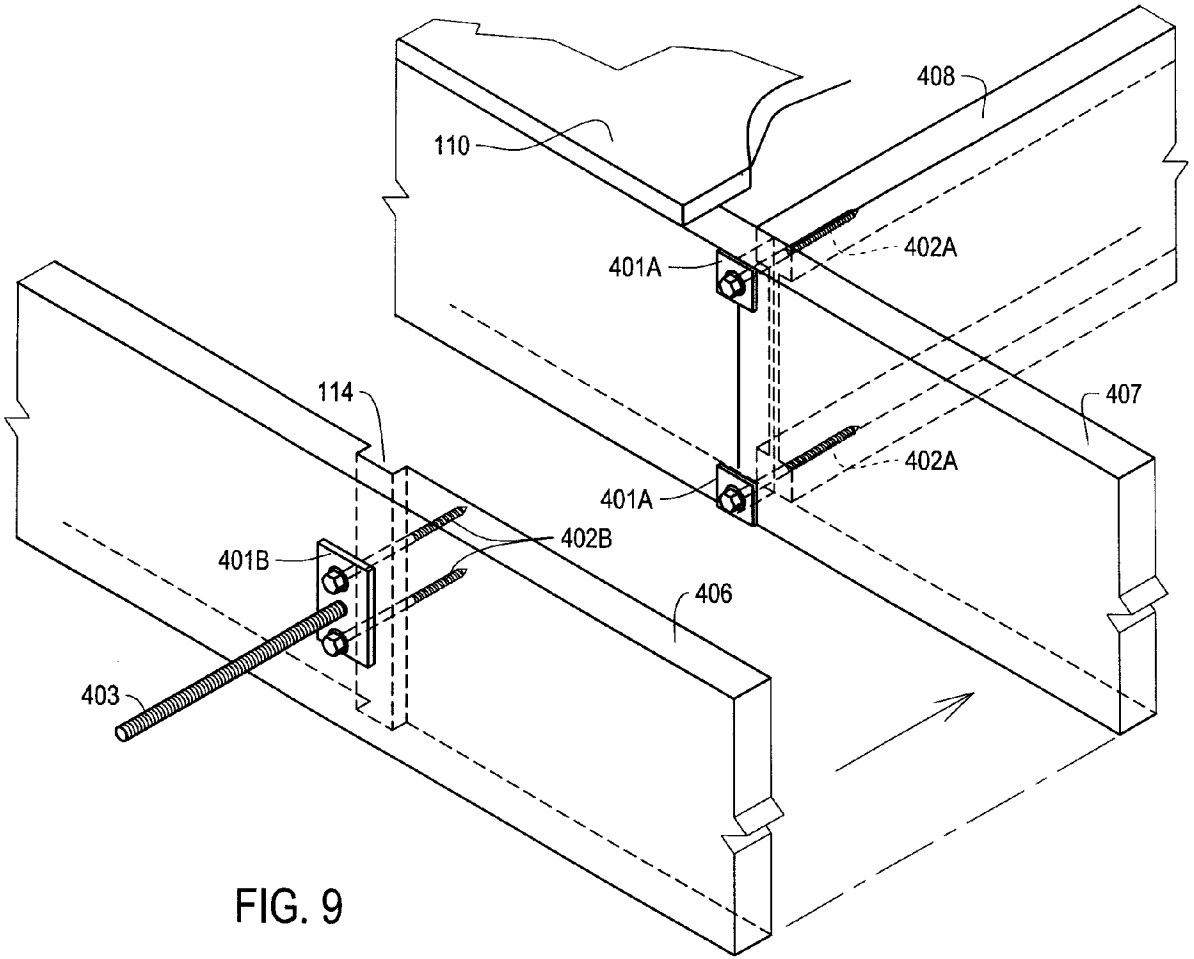
FIG. 9 shows an isometric view of the deck attachment system according to the fourth embodiment.

Referring to FIGS. 8 and 9, a fourth embodiment describing a system for attaching a deck to a house is shown. The fourth embodiment is similar to the third embodiment except that the house joist 408 is an I-joist, which is used in some house configurations. In this case, the one attachment plate 401A can be provided on the outside longitudinal face of the house ledger 407. Each of the one or more attachment plates 401A may include attachment holes to enable one or more fastening components such as screws 402A to attach the attachment plates 401A to the house ledger 407. The screws may be further threaded into the I-joist 408. In some embodiments, a screw 402A for attaching one attachment plate 401A to the I-joist is provided and fastened into at an end face of the top "I" surface of the I-joist 408. Another screw 402A for attaching another attachment plate 401A to the I-joist is provided and fastened into at an end face of the bottom "I" surface of the I-joist 408.

Additionally, an attachment plate 401B may be provided on an outside longitudinal face of the deck ledger 406. The attachment plate may include a plurality of attachment holes, and through at least one of those holes, one or more fastening components such as screws 402B that extend into the house ledger 407 may be provided. The one or more screws 402B may protrude through the house ledger 407, but not through the house joist 408. In some configurations, the one or more screws may reach and protrude the house ledger 407 with a screw disposed on either side of the attachment plates 401A in a longitudinal direction of the house ledger 407.

The attachment plate 401B may be provided with one or more connecting holes for connecting the attachment plate 401B to the deck. In some embodiments, through the one or more connecting holes, a connecting component 403 may be placed through the attachment plate 401B and onto the deck ledger 406. The connecting component 403 may be anchored by means of a nut 404 disposed on the end of the connecting component 403 at a location along the longitudinal inner face of the deck ledger 406, for example at an end of the connecting component closest to the house ledger 407. As with the first two embodiments, the connecting component may be a threaded rod, or any other component capable of properly connecting the attachment plate to the deck ledger. In embodiments where a threaded rod is used, the threaded rod may be threaded through a hole on a surface of the deck ledger, and to the deck joist 405.

The material and sizes of the attachment plates 401A and 401B, as well as the screws 402A and 402B are selected so as to ensure satisfaction of building codes. The attachment plates may be provided in dimensions suitable to accommodate the appropriate tension and bear the appropriate weight under building codes and may be of similar dimensions as those described in the first embodiment.

In this embodiment, when a lateral load is applied to connecting component 403, the load may be transferred to the attachment plate 401B by means of a nut 404 on an end of the connecting component 403. The attachment plate 401B load is then transferred to the screws 402B, which are screwed through the deck ledger 406 and into the house ledger 407. This transfers the load to the house ledger 407. The load on the house ledger 407 can then be transferred to the attachment plates 401A via their direct or indirect connections and any applied tension, and the load at the attachment plates 401A can be transferred to the screws 402A, which are screwed into top and bottom portions of the house I-joist 408.

Figure 10:
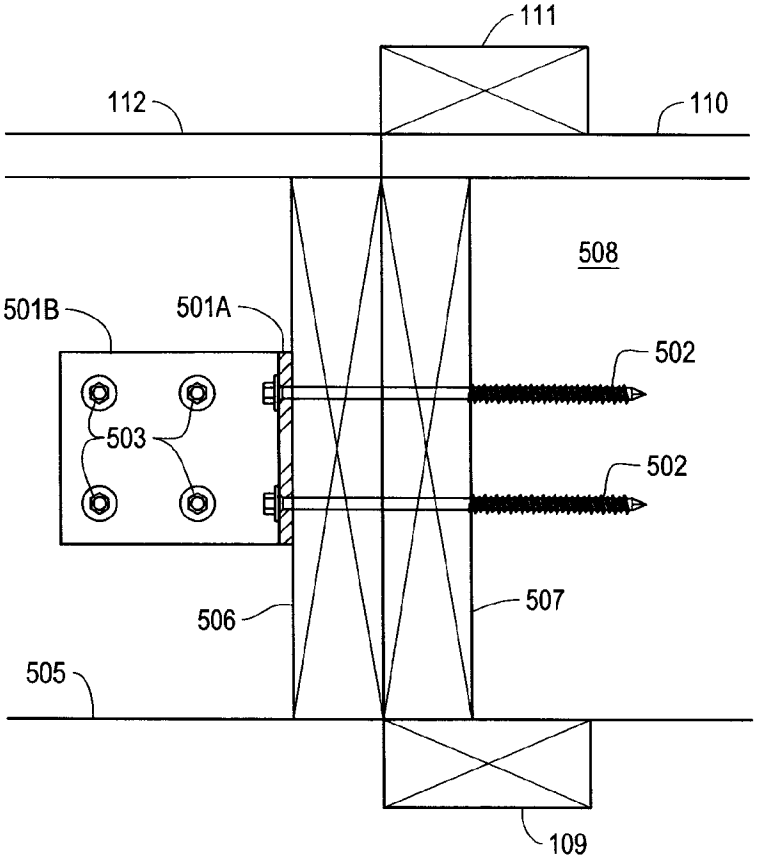
FIG. 10 shows a deck attachment system according to a fifth embodiment.
Figure 11:
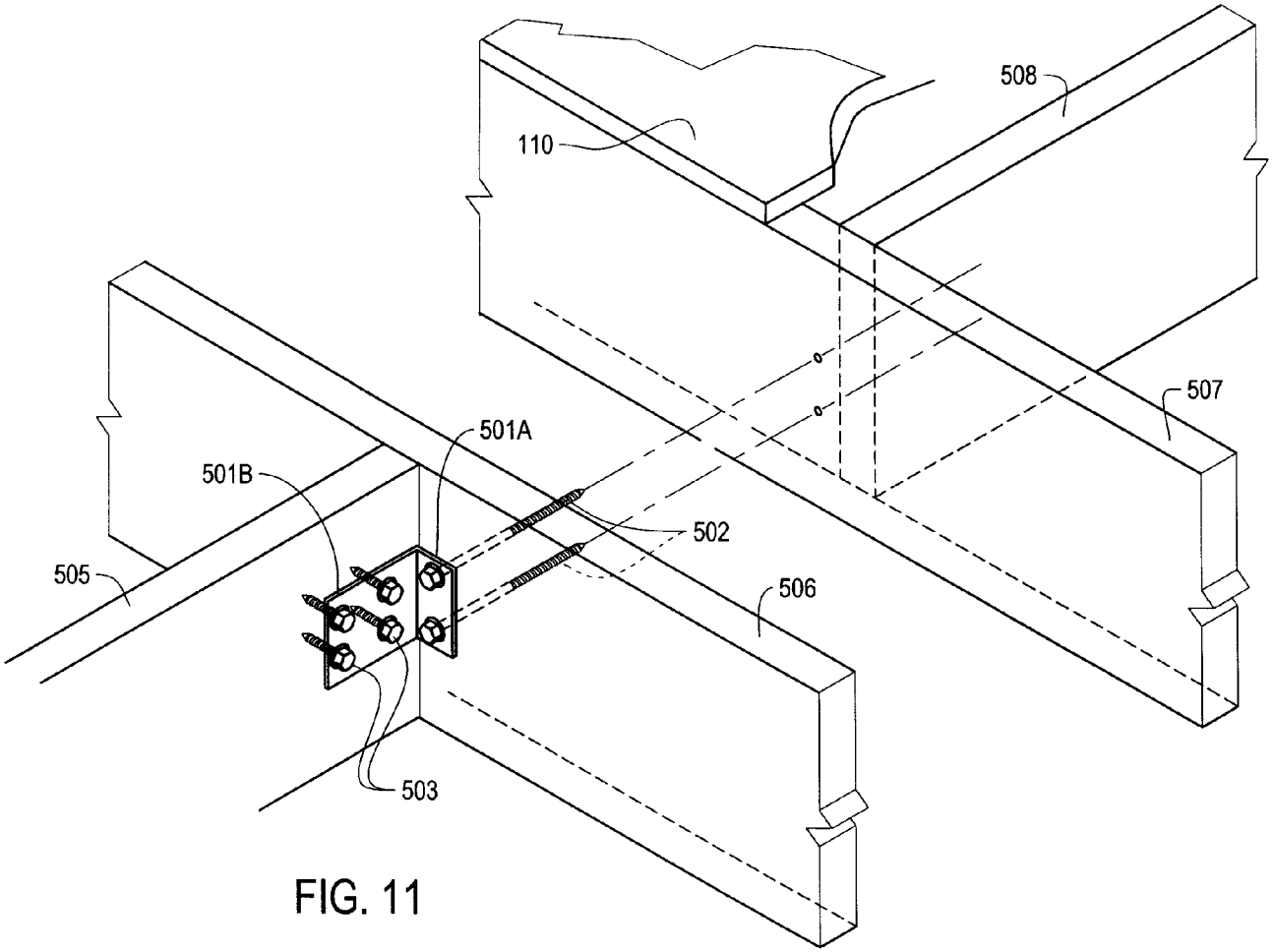
FIG. 11 shows an isometric view of the deck attachment system according to the fifth embodiment.

Referring to FIGS. 10 and 11, a fifth embodiment describing a system for attaching a deck to a house is shown. This embodiment includes many similar characteristics as the first to fourth embodiments described above. In this embodiment, an angled attachment plate 501 having first portion 501A and second portion 501B is attached to the deck ledger 506. Portion 501B is connected to the deck joist 505 via connecting screws 503. Thus, the connecting component as it pertains to this embodiment can be considered portion 501B of the angled attachment plate, screws 503, or both. This embodiment thus may not utilize a threaded rod for a connection to the deck joist 505, nor does it require any traditional connections from the rod to the deck joist. Portion 501B of the angled attachment plate and screws 503 allow for a connection of the deck joist to the portion 501A of the angled attachment plate. Portion 501A of the angled attachment plate is then attached to the deck ledger 506 via screws 502, and further connected to the house ledger 507 and deck joist 508 via the screws 502.

In this embodiment, the lag screws are long enough to reach from the angled attachment plate portion 501A disposed on the outside of the deck ledger 506 to the house ledger 507. The screws may be further threaded into the end face of the house floor joist 508. The lag screws 502 may be of a length from about 2 inches to about 8 inches, or about 4 inches to about 8 inches.

Thus, when a lateral load is applied to the angled attachment plate 501 at the deck joist 505, the load can be transferred to the lag screw 502, which are screwed through deck ledger 506 and house ledger 507 and into the end face of the house joist 508. The load can thus be transferred from the screws 502 to the house ledger 508.

One skilled in the art would recognize that the angled attachment plate 501 may also be used in conjunction with, or in addition to, the structures described in the first through fourth embodiments. For example, in the third and fourth embodiments, the angled attachment plate 501 may be used instead of the attachment plates 301A/401A, the connecting components 303 and 403, and the nuts 304 and 404.

Owing to the configurations in one or more of the embodiments above, a contractor or installer will advantageously be able to install the deck to the structure in an efficient, simplified manner, and may be able to avoid any entry into the structure itself. Further, the configurations in one or more of the embodiments may allow for a reduction in mold or other disadvantegous buildup of fluid or the like at connection points between the deck and the structure.

While the above embodiments reference a deck connection to a house, it will be appreciated that such a connection may be applicable for attaching a deck to any structure, such as a commercial building. Further, the connection may also be applicable for attaching any external component to a structure or building, and thus is not limited to attaching a deck, as described herein. While the embodiments particularly refer to screws as an exemplary fastening component, one skilled in the art would understand that any fastening component under the definitions provided herein may be suitable. Additionally, while the embodiments particularly refer to a threaded rod as an exemplary connecting component, one skilled in the art would understand that any connecting component under the definitions provided herein may be suitable for use.

The above FIGS. 2-11 show systems that allow for one connection of a deck ledger to a house ledger. Additionally, in connecting a deck to a house, the systems shown in FIGS. 2-11 can be provided in concert with, or in addition to, other connections based upon traditional methods, provided the connections comply with the applicable weight-bearing requirements under the applicable codes. Further, one skilled in the art would appreciate that each of the embodiments described above are not mutually exclusive. At different attachment points throughout a house-deck connection, different embodiments may be used. Additionally, unless otherwise disclosed, the embodiments described in FIGS. 4-11 may include similar structural and functional characteristics as those described with reference to FIGS. 2 and 3. One skilled in the art would recognize that the attachment system provided herein may be used in other applications requiring particular weight bearing attachment.

Further, although the preceding description has been described herein with reference to particular means, materials and embodiments, it is not intended to be limited to the particulars disclosed herein; rather, it extends to all functionally equivalent structures, methods and uses, such are within the scope of the appended claims.

What is claimed is:

1. A deck attachment system for attaching a deck having a deck joist and a deck ledger to a structure having a structure ledger, comprising:

at least one flat metal attachment plate with one or more fastener holes;

at least one fastening component oriented so as to be capable of attaching the at least one flat metal attachment plate to at least one of the deck ledger, the structure ledger and a structure floor joist;

at least one connecting component capable of connecting the at least one flat metal attachment plate to at least a portion of the deck joist; and the structure floor joist, wherein the at least one fastening component is fastened directly into an end face of the structure floor joist.

2. The deck attachment system according to claim 1, wherein the at least one flat metal attachment plate is directly attached to the structure ledger.

3. The deck attachment system according to claim 1, wherein the at least one flat metal attachment plate is directly attached to the deck ledger.

4. The deck attachment system according to claim 1, wherein the at least one flat metal attachment plate comprises a first flat metal attachment plate and a second flat metal attachment plate, and wherein the at least one fastening component comprises a first fastening component and a second fastening component, wherein the at least one first flat metal attachment plate is directly attached to the deck ledger and includes the at least one first fastening component extending into the floor joist of the structure, and wherein the at least one second flat metal attachment plate is directly attached to the house ledger and includes the at least one second flat metal fastening component extending into the deck ledger, wherein the connecting component is connected to the second flat metal attachment plate at one end and extends into the deck joist.

5. The deck attachment system according to claim 1, wherein the connecting component is a threaded rod.

6. The deck attachment system according to claim 5, wherein the threaded rod is fixed at one end by a nut, and extends at an other end onto the deck joist.

7. The deck attachment system according to claim 5, wherein the threaded rod extends into the structure ledger.

8. The deck attachment system according to claim 5, wherein the at least one fastening component is a lag screw.

9. The deck attachment system according to claim 1, wherein the at least one flat metal attachment plate is directly attached to the structure ledger.

10. The deck attachment system according to claim 1, wherein the at least one flat metal attachment plate is directly attached to the deck ledger.

11. The deck attachment system according to claim 10, wherein attachment screws extending from the at least one of the plurality of flat metal attachment plates directly attached to the deck ledger extends to the structure ledger, thereby connecting the deck ledger to the structure ledger.

12. The deck attachment system according to claim 1, wherein the at least one flat metal attachment plate comprises a plurality of flat metal attachment plates, wherein at least one of the plurality of flat metal attachment plates is disposed on the structure ledger, and at least one of the plurality of flat metal attachment plates is disposed on the deck ledger.

13. The deck attachment system according to claim 12, wherein the at least one flat metal attachment plate includes at least a first flat metal attachment plate and a second flat metal attachment plate, wherein the structure floor joist is an I-joist, and wherein the first flat metal attachment plate disposed on an end face of a top portion of the I-joist and the second flat metal attachment plate disposed on an end face of a bottom portion of the I-joist.

14. The deck attachment system according to claim 1, wherein the at least one flat metal attachment plate is comprised of sheet metal, and the fastening components are lag screws having a diameter of about ¼ inches to about ⅜ inches.

15. A deck attachment system, comprising:

a structure ledger;

a structure floor joist;

a deck ledger;

a deck joist;

at least one flat metal attachment plate with at least one fastener hole;

at least one connecting component for directly or indirectly connecting the at least one attachment plate with at least one of the deck ledger and the deck joist; and at least one fastening component that attaches the at least one flat metal attachment plate to least one of the deck ledger and the structure ledger, wherein the at least one fastening component is fastened into an end face of the structure floor joist.

16. The deck attachment system according to claim 15, wherein the end face of the structure floor joist is an end grain of the structure floor joist.

17. The deck attachment system according to claim 15, wherein the structure ledger is a house ledger and the structure floor joist is a house floor joist.

18. A method for attaching a deck to a structure having a structure floor joist, comprising:

fastening a flat metal attachment plate to at least one of a structure ledger or a deck ledger by means of at least one fastening component; and connecting the flat metal attachment plate to a deck joist by means of a connecting component, wherein the at least one fastening component is fastened into an end face of the structure floor joist.

19. The method according to claim 18, wherein the at least one fastening component is a lag screw and is fastened in direct withdraw with respect to the flat metal attachment plate.

* * * * *